US006915960B2

(12) United States Patent
Luft

(10) Patent No.: US 6,915,960 B2
(45) Date of Patent: Jul. 12, 2005

(54) FUEL-INJECTION AND A METHOD FOR SETTING THE SAME

(75) Inventor: Heinz Luft, Hirschaid (DE)

(73) Assignee: Robert Bosch GmbH, Stuttgart (DE)

( * ) Notice: Subject to any disclaimer, the term of this patent is extended or adjusted under 35 U.S.C. 154(b) by 148 days.

(21) Appl. No.: 10/362,084

(22) PCT Filed: May 7, 2002

(86) PCT No.: PCT/DE02/01643

§ 371 (c)(1),
(2), (4) Date: Jul. 30, 2003

(87) PCT Pub. No.: WO03/001050

PCT Pub. Date: Jan. 3, 2003

(65) Prior Publication Data

US 2004/0011898 A1 Jan. 22, 2004

(30) Foreign Application Priority Data

Jun. 22, 2001 (DE) ..... 101 30 239

(51) Int. Cl.[7] ..... F02D 1/06

(52) U.S. Cl. ..... 239/5; 239/585.1; 239/585.3; 239/533.2; 239/533.3; 239/533.6; 251/129.16

(58) Field of Search ..... 239/5, 585.1, 585.3, 239/585.5, 533.2, 533.3, 533.4, 533.5, 533.6; 251/129.08, 129.15, 129.16, 129.17, 129.18

(56) References Cited

U.S. PATENT DOCUMENTS 3,387,790 A * 6/1968 De Luca ..... 239/453
3,398,936 A * 8/1968 Delano ..... 239/533.11
3,567,133 A * 3/1971 Gewinner ..... 239/533.6
4,225,088 A * 9/1980 Kulke et al. ..... 239/533.5
4,889,288 A * 12/1989 Gaskell ..... 239/533.5

FOREIGN PATENT DOCUMENTS

| | | |
|---|---|---|
| DE | 40 23 826 | 1/1992 |
| DE | 40 23 828 | 1/1992 |
| DE | 41 09 868 | 10/1992 |
| DE | 41 23 787 | 1/1993 |
| DE | 42 11 723 | 4/1993 |
| DE | 44 31 128 | 3/1996 |
| DE | 195 16 513 | 11/1996 |
| DE | 100 37 570 | 2/2002 |
| DE | 100 37 571 | 2/2002 |
| JP | 1-138366 | 5/1989 |

* cited by examiner

*Primary Examiner*—Dinh Q. Nguyen
(74) *Attorney, Agent, or Firm*—Kenyon & Kenyon

(57) ABSTRACT

A fuel injector for fuel-injection systems of internal combustion engines, e.g., for the direct injection of fuel into the combustion chamber of an internal combustion engine, includes an actuator, a valve needle which is in operative connection to the actuator and acted upon by a restoring spring in a closing direction, to actuate a valve-closure member which forms a sealing seat together with a valve-seat surface, and an adjustment sleeve, which provides the restoring spring with an initial stress. The adjustment sleeve has a cup-shaped design and an eccentric bore in a base, which is in variable alignment with an eccentric bore in a base of a cup-shaped inner sleeve able to be inserted into the adjustment sleeve.

16 Claims, 2 Drawing Sheets

FUEL-INJECTION AND A METHOD FOR SETTING THE SAME

FIELD OF THE INVENTION

The present invention relates to a fuel injector and a method for adjusting a fuel injector.

BACKGROUND INFORMATION

A method for adjusting a fuel injector, as well as a fuel injector are described in German Published Patent Application No. 40 23 828. To adjust the flow quantity of a medium released during the opening and closing process of an electromagnetically actuable fuel injector, a magnetically conductive material is introduced into a blind-end bore, in powder form, for instance, the material being able to change the magnetic properties of the inner pole, thereby varying the magnetic force, until the measured actual flow rate of the medium corresponds to the predefined setpoint quantity.

It is described in German Published Patent Application No. 40 23 826 to insert an adjusting bolt into a blind-end bore of an inner pole provided with an opening at its periphery, and thereby vary the magnetic force. The adjusting bolt is inserted such that the measured actual quantity conforms to the predefined setpoint quantity.

In German Published Patent Application No. 195 16 513, a method is described for adjusting the flow rate of a dynamic medium of a fuel injector. In this case, an adjusting element positioned near the magnetic coil, outside the flow route of the medium, is adjusted, causing a change in the magnitude of the magnetic flow in the magnetic circuit and, thus, in the magnetic force, so that the flow rate of the medium is able to be influenced and adjusted. The adjustment may be performed both in a wet and a dry fuel injector.

German Published Patent Application No. 42 11 723 describes a fuel injector and a method for adjusting the flow rate of a dynamic medium of a fuel injector. In this case, an adjustment sleeve, having a longitudinal slit, is pressed into a longitudinal bore of a connecting piece up to a predefined pressing depth, the valve's instantaneous quantity of a dynamic medium is measured and compared to a setpoint quantity of the medium, and the pressed-in adjustment sleeve, which is under a tension acting in the radial direction, is advanced until the measured instantaneous quantity of the medium conforms to the predefined setpoint quantity of the medium.

As described in German Published Patent Application No. 44 31 128, to adjust the flow rate of a dynamic medium of a fuel injector, a deformation of the valve housing occurs by a deformation tool engaging on the outer circumference of the valve housing. In the process, the size of the residual-air gap between the core and the armature and, thus, the magnitude of the magnetic force, changes, so that the flow rate of the medium is able to be influenced and adjusted.

Particularly disadvantageous in the group of methods, which influence the magnitude of the magnetic flow in the magnetic circuit, is the high production cost, since the required static flow-rate tolerances must be assured, which is difficult to realize, however. The measurements of the magnetic fields are costly and, in most cases, require cost-intensive methods and also a testing field.

Disadvantageous in the group of mechanical adjustment methods, in particular, is the high imprecision to which these methods are subject. Furthermore, the opening and closing times of a fuel injector can only be shortened at the expense of the electric output, thereby increasing the electrical load of the components and placing greater demands on the control devices.

Especially the method described in German Published Patent Application No. 44 31 128, in which the residual-air gap between the core and armature is modified by deformation of the valve housing, is unable to correct the flow rate with high precision, since shear stresses in the nozzle body influence the direction and magnitude of the deforming force in a disadvantageous manner. For this reason, all parts require high manufacturing precision.

SUMMARY

The fuel injector and the method according to the present invention may provide eccentric bores in the bases of the adjustment sleeve and in the inner sleeve inserted therein, to adjust the dynamic flow rate according to the desired fuel quantity, and may be brought into varying degrees of alignment for a resulting diaphragm-cross section, without influencing the adjustment of the static flow, or vice versa.

The adjustment sleeve and the inner sleeve may be able to be produced in an uncomplicated and inexpensive manner.

The inner sleeve may be held in place in the adjustment sleeve by a spring ring, thereby avoiding an adjustment of the inner sleeve and, thus, a change in the resulting diaphragm cross-section during operation of the fuel injector. In this manner, the static flow rate may be reliably adjusted.

The method steps for adjusting the dynamic and the static flow may be executed in any order, depending on the given installation possibilities.

The diaphragm may increase the static flow rate from a preset mean diaphragm cross-section up to an unthrottled maximum value, by increasing the diaphragm cross-section, and decrease it to approximately zero by reducing the diaphragm cross-section.

An exemplary embodiment of the present invention is illustrated schematically in the drawings and explained in greater detail in the following description.

DETAILED DESCRIPTION

Figure 1:
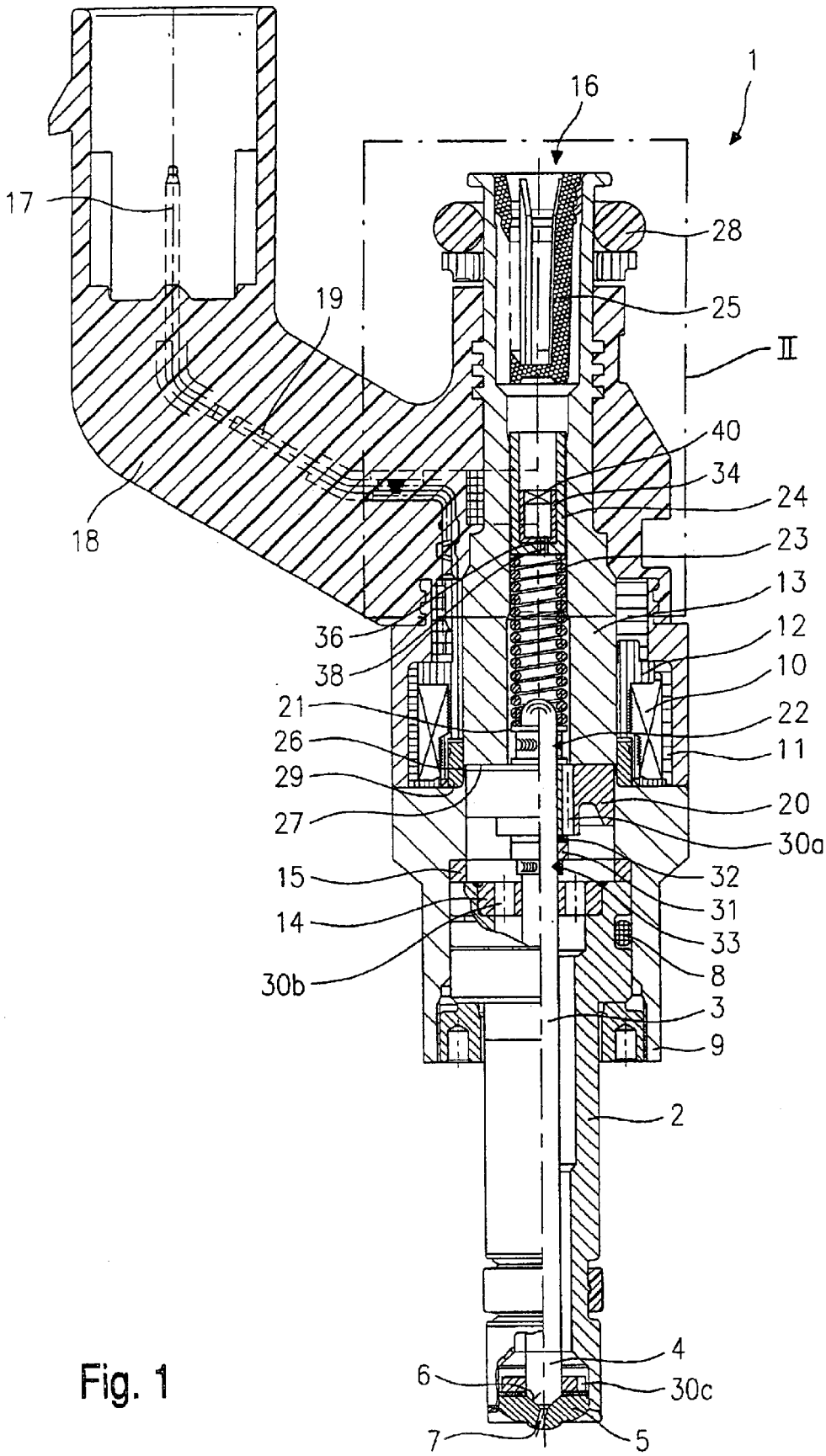
FIG. 1 is a schematic cross-sectional view through an exemplary embodiment of a fuel injector according to the present invention.

An exemplary embodiment of a fuel injector 1 according to the present invention is configured in the form of a fuel injector 1 for fuel-injection systems of mixture-compressing internal combustion engines having externally supplied ignition. Fuel injector 1 may be suited for the direct injection of fuel into a combustion chamber of an internal combustion engine.

Fuel injector 1 includes a nozzle body 2 in which a valve needle 3 is positioned. Valve needle 3 is in operative connection with a valve-closure member 4, which cooperates with a valve-seat surface 6, located on a valve-seat member 5, to form a sealing seat. In the exemplary embodiment, fuel injector 1 is an inwardly opening fuel injector 1, which has one spray-discharge orifice 7. Seal 8 seals nozzle body 2 from an outer pole 9 of a magnetic coil 10. Magnetic coil 10 is encapsulated in a coil housing 11 and wound on a coil brace 12, which rests against an inner pole 13 of magnetic coil 10. Inner pole 13 and outer pole 9 are separated from each other by a constriction 26 and are interconnected by a non-ferromagnetic connecting part 29. Magnetic coil 10 is energized via a line 19 by an electric current, which may be supplied via an electrical plug contact 17. A plastic coating 18, which may be extruded onto inner pole 13, encloses plug contact 17.

Valve needle 3 is guided in a valve-needle guide 14, which is disk-shaped. A paired adjustment disk 15 is used to adjust the (valve) lift. An armature 20 is on the other side of adjustment disk 15. It is connected by force-locking to valve needle 3 via a first flange 21, and valve needle 3 is connected to first flange 21 by a welded seam 22. Braced against first flange 21 is a restoring spring 23 which, in the present design of fuel injector 1, is prestressed by a sleeve 24.

The position of adjustment sleeve 24 is responsible for the initial stress of restoring spring 23 and, thus, for the dynamic flow rate through fuel injector 1. The higher the initial stress of restoring spring 23, the longer it takes when current is supplied to magnetic coil 10 for the magnetic field to be strong enough to pull armature 20 to inner pole 13, counter to the spring force of restoring spring 23.

To adjust the static flow rate through fuel injector 1, the present invention provides for an inner sleeve 34, which is inserted into adjustment sleeve 24. Inner sleeve 34 is cup-shaped and has an eccentric bore 36 in a base 35 of inner sleeve 34. Adjustment sleeve 24 also has a cup-shaped configuration and is provided with an eccentric bore 38 in a base 37 of adjustment sleeve 24. Eccentric bores 36 and 38 are configured such that they are able to be brought into alignment. A detailed description of the measures according to the present invention and the functioning method of inner sleeve 34 may be inferred from FIGS. 2 and 3 and the following description.

Fuel channels 30*a* through 30*c* extend in valve-needle guide 14, in armature 20 and valve-seat member 5. The fuel is supplied via a central fuel feed 16 and filtered by a filter element 25. Seal 28 seals fuel injector 1 from a fuel line.

On the spray-discharge side of armature 20 is an annular damping element 32 made of an elastomeric material. It rests on a second flange 31, which is joined to valve needle 3 by force-locking via a welded seam 33.

In the rest state of fuel injector 1, armature 20 is acted upon by restoring spring 23, in a direction opposite to its lift direction, such that valve-closure member 4 is sealingly held against valve seat 6. In response to excitation of magnetic coil 10, it generates a magnetic field, which moves armature 20 in the lift direction, counter to the spring force of restoring spring 23, the lift being predefined by a working gap 27, which occurs in the rest position between inner pole 12 and armature 20. First flange 21, which is welded to valve needle 3, is also taken along by armature 20 in the lift direction. Valve-closure member 4, which is connected to valve needle 3, lifts off from valve seat surface 6, so that the fuel is spray-discharged through spray-discharge orifice 7.

In response to interruption of the coil current, following sufficient decay of the magnetic field, armature 20 falls away from inner pole 13 due to the pressure of restoring spring 23, whereupon first flange 21, being connected to valve needle 3, moves in a direction counter to the lift. Valve needle 3 is thereby moved in the same direction, causing valve-closure member 4 to set down on valve seat surface 6 and fuel injector 1 to be closed.

Figure 2:
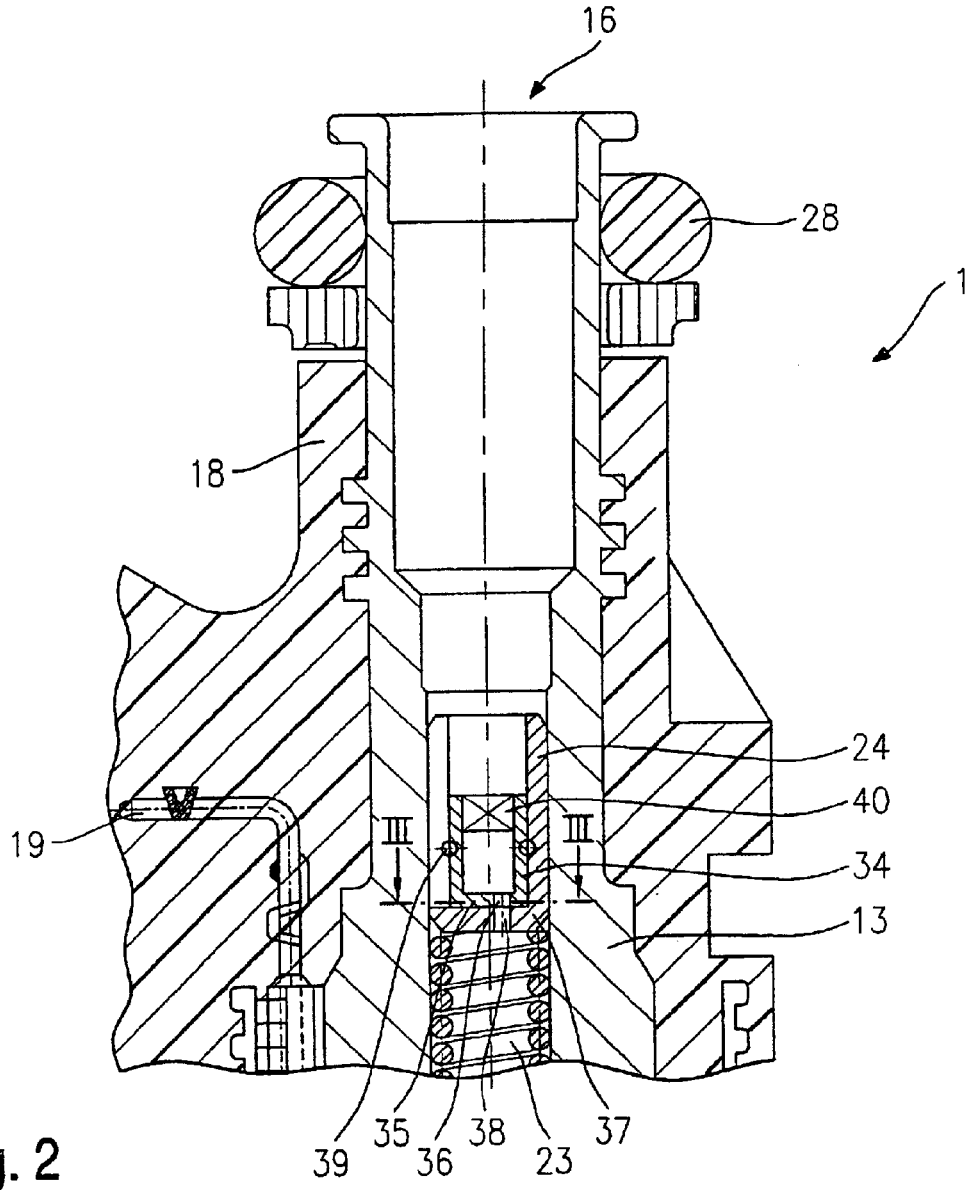
FIG. 2 is a schematic cross-sectional view through region II of the exemplary embodiment illustrated in FIG. 1.

FIG. 2 illustrates a part-sectional view of the detail, designated II in FIG. 1, of fuel injector 1 designed according to the present invention, without filter element 25 which is located in central fuel supply 16 illustrated in FIG. 1. According to the present invention, adjustment sleeve 24 has a base 37 which is provided with an eccentrically configured bore 38. Positioned in adjustment sleeve 24 is an inner sleeve 34 which has a cup-shaped design and a base 35 in which an eccentric bore 36 is configured. Inner sleeve 34 is dimensioned such that it is able to be affixed in adjustment sleeve 24 with the aid of a spring ring 39. Adjustment sleeve 24 has a slitted, matching design, so as to allow the installation of inner sleeve 34 by spring ring 39. Spring ring 39 may ensure that inner sleeve 34 is unable to rotate on its own during operation of fuel injector 1, so that the flow is not modified. The flow rate is correspondingly adjusted, counter to the retention force of spring ring 39.

Eccentric bores 36 and 38 are aligned in bases 35 and 37 such that they have a common axis. Inner sleeve 34 has a working surface 40 for a matching tool, for instance, a polygon, by which inner sleeve 34 is able to be twisted.

Following the preassembly of the components, the dynamic and static flows through fuel injector 1 are adjusted with the aid of adjustment sleeve 24 and inner sleeve 34. For this purpose, adjustment sleeve 24 is first pressed so far into fuel injector 1 that a desired value of the dynamic flow is obtained by an appropriate tension of restoring spring 23.

Subsequently, using the aforementioned tool which engages on working surface 40, inner sleeve 34 is twisted with respect to adjustment sleeve 24 until a diaphragm cross-section 41 is obtained by overlapping eccentric bores 36 and 38, which throttles the static flow rate to a desired value. The static flow rate is variable between an unthrottled value, given complete overlapping of bores 36 and 38, and a minimal value, given a nearly closed diaphragm cross-section 41.

The may system provide the possibility of adjusting the static and the dynamic through-flow through fuel injector 1 independently of one another, so that the afore-described working steps may also be implemented in reverse order.

Figure 3:
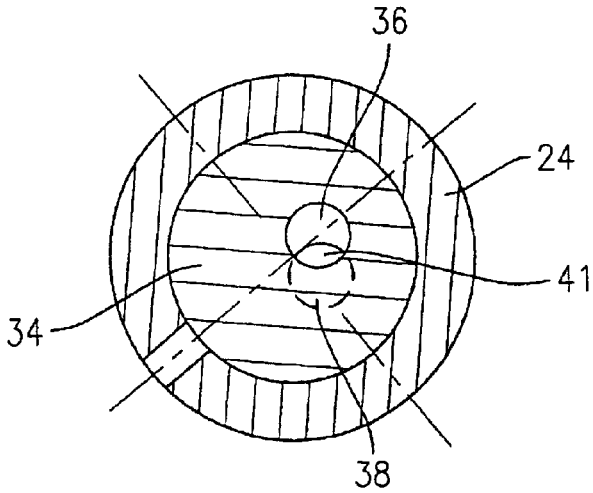
FIG. 3 is a schematic cross-sectional view through the adjustment sleeve of the fuel injector taken along line III—III.

FIG. 3 illustrates a cross-section through adjustment sleeve 24 and inner sleeve 34, the section being along the line III—III illustrated in FIG. 2.

As described above, the static flow through fuel injector 1 is determined via the resulting diaphragm cross-section 41 of bores 36 and 38 configured in inner sleeve 34 and in adjustment sleeve 24. For the purpose of illustration, an adjustment is illustrated in FIG. 3 by an example. Bore 38 of adjustment sleeve 24 is projected into the sectional plane of FIG. 3.

Diaphragm cross-section 41 may be modified at any time by removing filter element 25 from fuel supply 16 and twisting inner sleeve 34 with respect to adjustment sleeve 24 using an appropriate tool. Fuel injector 1 need not be removed in its entirety, nor is it necessary to remove components from fuel injector 1 in order to adjust the flows.

The present invention is not limited to the exemplary embodiments illustrated and may also be suitable, for instance, for fuel injectors 1 having piezoelectric or magnetostrictive actuators.

What is claimed is:

1. A fuel injector for a fuel-injection system of an internal combustion engine, comprising:

an actuator;

a restoring spring;

a valve-closure member arranged to form a sealing seat with a valve-seat surface;

a valve needle in operative connection to the actuator and acted upon by the restoring spring in a closing direction to actuate the valve-closure;

a cup-shaped adjustment sleeve configured to provide the restoring spring with an initial stress, the adjustment sleeve including a bore in a base; and a cup-shaped inner sleeve including a bore in a base, the inner sleeve insertable into the adjustment sleeve, the bore of the adjustment sleeve and the bore of the inner sleeve variably alignable.

2. The fuel injector according to claim 1, wherein the bores are eccentrically arranged in the bases.

3. The fuel injector according to claim 2, wherein a position of the eccentric bores with respect to one another defines a resulting diaphragm cross-section.

4. The fuel injector according to claim 3, wherein the inner sleeve is adjustably disposed in the adjustment sleeve so that a fuel quantity flowing through the fuel injector per unit of time is a function of the resulting diaphragm cross-section.

5. The fuel injector according to claim 1, wherein the inner sleeve has a working surface for an adjustment tool.

6. The fuel injector according to claim 5, wherein the inner sleeve is twistable in the adjustment sleeve by the adjustment tool.

7. The fuel injector according to claim 1, further comprising a spring ring, the inner sleeve affixed in the adjustment sleeve by the spring ring.

8. The fuel injector according to claim 1, wherein the adjustment sleeve is slit.

9. The fuel injector according to claim 1, wherein the fuel injector is configured for direct injection of fuel into a combustion chamber of the internal combustion engine.

10. A method for adjusting a fuel injector for a fuel-injection system of an internal combustion engine, the fuel injector including an actuator, a restoring spring, a valve-closure member arranged to form a sealing seat with a valve-seat surface, a valve needle in operative connection to the actuator and acted upon by the restoring spring in a closing direction to actuate the valve-closure, a cup-shaped adjustment sleeve configured to provide the restoring spring with an initial stress, the adjustment sleeve including a bore in a base, and a cup-shaped inner sleeve including a bore in a base, the inner sleeve insertable into the adjustment sleeve, the bore of the adjustment sleeve and the bore of the inner sleeve variably alignable, comprising:

adjusting a static flow rate of the fuel injector; and adjusting a dynamic flow rate of the fuel injector.

11. The method according to claim 10, wherein the static flow rate adjusting includes:

measuring a static instantaneous flow rate of the fuel injector;

comparing the measured instantaneous flow rate to a static setpoint flow rate; and adjusting the inner sleeve in the adjustment sleeve until the instantaneous flow rate corresponds to the static setpoint flow rate.

12. The method according to claim 11, wherein the inner sleeve is adjusted in the adjustment sleeve in the inner sleeve adjusting step by twisting with an adjustment tool.

13. The method according to claim 10, wherein the dynamic flow rate adjusting includes comprises:

measuring a dynamic instantaneous flow rate of the fuel injector;

comparing the measured instantaneous flow rate to a dynamic setpoint flow rate; and adjusting the adjustment sleeve of the fuel injector until the instantaneous flow rate corresponds to the dynamic setpoint flow rate.

14. The method according to claim 13, wherein the adjustment sleeve is adjusted in the adjustment sleeve adjusting step by sliding using a tool.

15. The method according to claim 10, wherein the adjusting of the static flow rate by a twisting of the inner sleeve and the adjusting of the dynamic flow rate by an axial sliding of the adjustment sleeve are performed independently of one another.

16. The method according to claim 10, wherein the fuel injector is configured for direct injection of fuel into a combustion chamber of the internal combustion engine.

* * * * *

UNITED STATES PATENT AND TRADEMARK OFFICE

CERTIFICATE OF CORRECTION

PATENT NO. : 6,915,960 B2
APPLICATION NO. : 10/362084
DATED : July 12, 2005
INVENTOR(S) : Heinz Luft It is certified that error appears in the above-identified patent and that said Letters Patent is hereby corrected as shown below:

Column 4, line 38, change "The may system provide the possibility" to --The system may provide the possibility--

Signed and Sealed this

Nineteenth Day of September, 2006

JON W. DUDAS
*Director of the United States Patent and Trademark Office*